US008011114B2

(12) United States Patent
Johnson

(10) Patent No.: US 8,011,114 B2
(45) Date of Patent: Sep. 6, 2011

(54) VEHICLE DRYER WITH BUTTERFLY INLET VALVE

(75) Inventor: Archie L. Johnson, Phoenix, AZ (US)

(73) Assignee: Superior Investments, Inc., Phoenix, AZ (US)

( * ) Notice: Subject to any disclaimer, the term of this patent is extended or adjusted under 35 U.S.C. 154(b) by 0 days.

(21) Appl. No.: 12/631,042

(22) Filed: Dec. 4, 2009

(65) Prior Publication Data

US 2010/0083526 A1 Apr. 8, 2010

(51) Int. Cl.
*F26B 25/00* (2006.01)

(52) U.S. Cl. ..... 34/413; 34/497; 34/666; 34/220; 454/234; 454/235; 15/2; 15/302; 165/292; 239/8; 392/384; 392/385; 62/244; 62/258

(58) Field of Classification Search ..... 34/406, 34/413, 497, 666, 220, 80, 90, 58; 392/384, 392/385; 62/244, 258; 454/234, 235; 15/2, 15/302; 165/292
See application file for complete search history.

(56) References Cited

U.S. PATENT DOCUMENTS 2,008,183 A * 7/1935 McCord ..... 392/381
2,114,776 A * 4/1938 Davis ..... 68/18 R
2,202,981 A * 6/1940 Behrens ..... 239/214.21
2,264,880 A * 12/1941 Hetzer ..... 34/280
2,264,887 A * 12/1941 Otis ..... 34/280
2,374,968 A * 5/1945 Arey et al. ..... 34/527
2,692,759 A * 10/1954 Swenson et al. ..... 165/292
2,860,070 A * 11/1958 McDonald ..... 427/297
2,960,990 A * 11/1960 Jones et al. ..... 134/95.3
2,986,917 A * 6/1961 Smith ..... 68/20
3,011,203 A 12/1961 Holtzclaw
3,122,908 A * 3/1964 Stanulis et al. ..... 68/12.09
3,139,633 A * 7/1964 Fecho et al. ..... 8/158
3,183,607 A * 5/1965 Beachler ..... 34/122
3,203,112 A * 8/1965 Edmonds ..... 34/104
3,236,073 A * 2/1966 Davison et al. ..... 68/12.08
3,237,314 A * 3/1966 Smith, Jr. ..... 34/266
3,263,592 A * 8/1966 Hickey et al. ..... 99/339
3,286,369 A * 11/1966 Smith, Jr. ..... 34/278
3,312,266 A * 4/1967 Dibert ..... 432/55
3,388,567 A * 6/1968 Oles ..... 68/18 R
(Continued)

FOREIGN PATENT DOCUMENTS

CH 664093 A * 2/1988
(Continued)

OTHER PUBLICATIONS

Power Lock Air Valve brochure, MacNeil Wash Systems Limited, Mar. 17, 2008, pp. 1-2.

*Primary Examiner* — Stephen M. Gravini
(74) *Attorney, Agent, or Firm* — Cahill Glazer PLC

(57) ABSTRACT

A vehicle dryer includes an energy-conserving rotatable inlet butterfly valve to selectively admit or block air to a fan encased in a blower housing. The valve includes a plate mounted on a shaft that extends across the inlet portion of the blower housing. The plate is rotated by its shaft to either an opened position for admitting air into a blower housing, or a closed position for blocking air from entering into the blower housing. A crank arm is coupled to the valve shaft, and a pneumatic cylinder includes a piston rod for turning the crank arm through a ninety-degree angle, thereby rotating the valve plate between its opened and closed positions.

21 Claims, 3 Drawing Sheets

U.S. PATENT DOCUMENTS 3,406,954 A * 10/1968 Fannon, Jr. ..... 432/41
3,424,356 A * 1/1969 Trunnell et al. ..... 223/32
3,442,027 A * 5/1969 Hurwitz ..... 34/571
3,525,161 A * 8/1970 Jesperson ..... 34/322
3,590,495 A * 7/1971 Tyson et al. ..... 34/654
3,643,342 A * 2/1972 Tyson et al. ..... 34/555
3,728,797 A * 4/1973 Worden et al. ..... 34/468
3,780,397 A * 12/1973 Harbeck et al. ..... 15/413
3,815,172 A * 6/1974 Fromknect et al. ..... 15/413
3,976,165 A * 8/1976 Pilarczyk ..... 184/6.16
3,998,071 A * 12/1976 Barthel ..... 62/430
4,055,003 A * 10/1977 Sack ..... 34/632
4,123,968 A * 11/1978 Malott ..... 454/354
4,145,788 A * 3/1979 Ferrarelli ..... 15/250.05
4,171,937 A * 10/1979 Greenfield ..... 417/423.15
4,209,875 A * 7/1980 Pugh et al. ..... 15/344
4,366,368 A * 12/1982 Stephens, III ..... 392/385
4,497,121 A * 2/1985 Choinski ..... 34/445
4,537,035 A * 8/1985 Stiles ..... 62/89
4,635,382 A * 1/1987 Bourdeau ..... 34/97
4,659,013 A * 4/1987 Ledebuhr et al. ..... 239/8
4,743,737 A * 5/1988 Tateishi ..... 392/365
4,836,467 A 6/1989 Rodgers
4,851,019 A * 7/1989 Ahlf et al. ..... 55/367
4,884,314 A * 12/1989 Miner et al. ..... 15/344
4,953,298 A * 9/1990 Carter et al. ..... 34/526
4,995,171 A * 2/1991 Yoshinaga et al. ..... 34/97
5,038,523 A * 8/1991 Farber et al. ..... 451/344
5,048,147 A * 9/1991 Belanger et al. ..... 15/319
5,099,545 A * 3/1992 Krasznai et al. ..... 15/344
5,155,925 A * 10/1992 Choi ..... 34/97
5,243,733 A * 9/1993 Steiner et al. ..... 15/330
5,259,816 A * 11/1993 Ke et al. ..... 454/244
5,325,604 A * 7/1994 Little ..... 34/493
5,367,739 A 11/1994 Johnson
5,400,464 A * 3/1995 Steiner ..... 15/330
5,460,717 A * 10/1995 Grimwood et al. ..... 210/175
5,513,953 A * 5/1996 Hansen ..... 415/183
5,599,229 A * 2/1997 Claunch et al. ..... 454/121
5,606,868 A * 3/1997 Calvert ..... 62/315
5,619,862 A * 4/1997 Ruger et al. ..... 62/409
5,692,702 A * 12/1997 Andersson ..... 244/1 N
5,751,307 A * 5/1998 Paroff et al. ..... 347/33
6,000,095 A 12/1999 Johnson
6,038,786 A * 3/2000 Aisenberg et al. ..... 34/267
6,041,607 A * 3/2000 Kim ..... 62/188
6,164,297 A * 12/2000 Kamikawa ..... 134/61
6,347,428 B1 * 2/2002 Shimko et al. ..... 15/320
6,360,548 B1 * 3/2002 Navarro ..... 62/93
6,449,877 B1 9/2002 Cote et al.
6,589,359 B2 * 7/2003 Kamikawa et al. ..... 134/26
6,857,282 B2 * 2/2005 Shichiken et al. ..... 62/244
6,997,005 B2 * 2/2006 Haasis ..... 62/258
7,096,657 B2 * 8/2006 Mahoney et al. ..... 60/39.25
7,128,526 B2 * 10/2006 Paulsen ..... 415/146
7,284,296 B2 10/2007 McElroy
7,513,975 B2 * 4/2009 Burma ..... 162/263
7,565,753 B2 7/2009 Christopher
7,687,045 B2 * 3/2010 Lu ..... 422/300
7,775,180 B2 * 8/2010 Denison et al. ..... 119/606
7,789,997 B2 * 9/2010 Rajanummi et al. ..... 162/272
2004/0083747 A1 * 5/2004 Shichiken et al. ..... 62/244
2004/0216322 A1 * 11/2004 Collier et al. ..... 34/97
2005/0147492 A1 * 7/2005 Mahoney et al. ..... 415/148
2005/0198987 A1 * 9/2005 Haasis ..... 62/257
2006/0236557 A1 * 10/2006 Bousfield ..... 34/96
2006/0286924 A1 * 12/2006 Milana ..... 454/259
2007/0107256 A1 * 5/2007 Wiener et al. ..... 34/497
2007/0151118 A1 * 7/2007 Perego ..... 34/275
2008/0011440 A1 * 1/2008 Rajanummi et al. ..... 162/272
2008/0304954 A1 * 12/2008 Hoffman et al. ..... 415/17
2009/0134623 A1 * 5/2009 Krouse ..... 290/43
2009/0151354 A1 * 6/2009 Dronzkowski et al. ..... 60/619
2009/0232643 A1 * 9/2009 Norris et al. ..... 415/151
2009/0272409 A1 * 11/2009 Petit ..... 134/32
2009/0282695 A1 * 11/2009 Kreutzfeldt et al. ..... 34/443
2009/0305612 A1 * 12/2009 Miyazaki et al. ..... 451/11
2010/0043839 A1 * 2/2010 Hamada et al. ..... 134/30
2010/0083526 A1 * 4/2010 Johnson ..... 34/443
2010/0158662 A1 * 6/2010 Colotte et al. ..... 415/33
2010/0158663 A1 * 6/2010 Colotte et al. ..... 415/33
2010/0192618 A1 * 8/2010 Zolli et al. ..... 62/428
2010/0287693 A1 * 11/2010 Gloodt ..... 4/541.1
2011/0052370 A1 * 3/2011 Karpman et al. ..... 415/13

FOREIGN PATENT DOCUMENTS

DE 4243731 C1 * 5/1994
EP 164111 A2 * 12/1985
EP 194553 A2 * 9/1986
FR 2821571 A1 * 9/2002
GB 2062361 A * 5/1981
GB 2154722 A * 9/1985
GB 2233218 A * 1/1991
JP 63219456 A * 9/1988
JP 63270265 A * 11/1988
JP 01032897 A * 2/1989
JP 01080331 A * 3/1989
JP 01208640 A * 8/1989
JP 03099963 A * 4/1991
JP 04126196 A * 4/1992
JP 05245094 A * 9/1993
JP 07217968 A * 8/1995
JP 08038398 A * 2/1996
JP 08332167 A * 12/1996
JP 09299283 A * 11/1997
JP 10071292 A * 3/1998
JP 10306998 A * 11/1998
JP 2000345977 A * 12/2000
JP 2008035974 A * 2/2008
WO WO 2004020107 A1 * 3/2004

* cited by examiner

VEHICLE DRYER WITH BUTTERFLY INLET VALVE

BACKGROUND OF THE INVENTION

1. Field of the Invention

The present invention relates generally to devices for blowing air across the surface of vehicles in order to dry moisture from such vehicles, and more particularly to a vehicle dryer that uses less power, and conserves energy.

2. Description of the Related Art

Automated vehicle washing systems have been available for many years to automatically wash and dry vehicles. Large volume vehicle washing systems typically include a conveyor system for moving a vehicle through a series of washing and rinsing stations, and finally, through a drying station which serves to remove moisture from the surface of the vehicle. Vehicle dryers are also commonly found within in-bay roll-over washing systems and in drive-through fleet vehicle washing systems.

A variety of drying stations are known for removing moisture from the vehicle. Touch-free drying stations often use one or more blower fans that supply blown air to dry the surfaces of the vehicle. In some cases, the blown air may be directed through ducts to vents positioned along the sides and above the path of the vehicle. In other cases, air discharged from the blower fans is immediately directed at the vehicle without intervening ducts or vents; such blower fans may either be fixed or oscillating. Oscillating blower fans better ensure adequate coverage for vehicles having a wide variety of contours.

Oftentimes these blower fans require motors rated at ten horsepower or more per fan to supply the proper rate of air flow. Such electric motors may be operated from a 220V AC electrical supply and may draw as much as 30 amps of current to rotate such blower fans, which typically rotate at speeds of 3,450 RPM. Such blower fans typically create an airflow rate of approximately 4,000 cubic feet per minute per fan. The operation of such blower fans can consume a significant amount of electrical power.

There are significant periods of time during the operation of a car wash facility during which there is no demand for blown air, e.g., periods when no vehicle is present within the car wash facility. One way to temporarily reduce power consumption is to turn off such blower fans when vehicles are not present. However, frequent starts and stops take a toll on electric motors and reduce their useful life. In addition, starting and stopping electric blower fan motors is not an effective way to reduce total power consumption. When such motors are initially started up, they draw much more electrical current before coming up to speed as compared to the amount of current drawn after the motor has reached normal operating speed. Accordingly, it is often preferred to allow such blower motors to run continuously during normal business hours, both to reduce overall electrical power usage and to reduce required maintenance for the electric motor.

Those skilled in the art have suggested several approaches to address the above-stated problems. For example, in U.S. Pat. No. 4,836,467 to Rodgers, a rotatable valve plate is inserted in the outlet of the blower fan assembly and is controlled by a solenoid. When a vehicle is present, this outlet valve is opened; when no vehicle is present, this outlet valve is closed. Rodgers reports a reduction of current from 100 amps with the outlet valve opened to approximately 40 amps with the outlet valve closed. Likewise, in U.S. Pat. No. 6,449,877 to Cote, et al., a rotatable control damper, or airfoil, is positioned between the outlet of a blower and a duct used to direct the blown air toward the vehicle. Cote's control damper is used to adjust the amount of air delivered in accordance with the type and profile of the vehicle to be dried.

Another method of decreasing the load on the fan motor when a vehicle is not present is to restrict air flow at the inlet of the fan. Blocking air at the inlet of the fan starves the fan of air, creates lower pressure within the fan housing, and reduces the load on the fan impeller. This relative vacuum allows the fan to rotate with less effort, thus decreasing the power required to keep the fan turning. In U.S. Pat. No. 7,284,296 to McElroy discloses a sliding valve plate disposed over the inlet of a blower housing to control the amount of air sucked into the inlet. The valve plate slides along a pair of rails, and a hydraulic cylinder moves the valve plate between its opened and closed positions. However, this sliding valve plate mechanism is relatively large and cumbersome, prone to mechanical breakage, requires significant force to open the valve, and is incompatible with many fan and blower types.

U.S. Pat. No. 7,565,753 to Christopher discloses a vehicle dryer assembly that includes a blower unit having an inlet and an outlet. A series of louvers are disposed at the inlet of the blower unit; the louvers are moveable between an open position and a closed position. A hydraulic cylinder is mechanically coupled to the louvers to move the louvers between their open and closed positions. Once again, this disclosed louver assembly is relatively large, and significantly increases the size of the blower housing. Christopher's louver assembly includes a number of moving parts that can break or bind, and is not easily adapted to many fan and blower types. In addition, Christopher's inlet plenum 20 is square, rather than circular, in order to accommodate Christopher's slatted louvers, which introduces a discontinuity in the air flow to the inlet of the generally circular blower housing.

MacNeil Wash Systems Ltd. of Barrie, Ontario, Canada has marketed an air valve under the trademark "Power Lock" which mounts over the inlet of a vehicle dryer. The valve assembly moves between an opened position spaced away from the inlet of the blower housing, and a closed position directly adjacent the inlet of the blower housing. Movement of the valve is controlled by routing pressurized air to the valve assembly. The valve assembly moves along an axis parallel to the axis of the fan motor. Promotional literature distributed by MacNeil Wash Systems Ltd. claims a reduction in motor horsepower of 50% when the valve is closed compared to when the valve is open. While such a device is helpful in reducing energy consumption, MacNeil's air valve device appears to impose a restriction in the incoming airflow when the valve is open. MacNeil's air valve device also adds approximately another twelve inches to the overall depth of the blower housing. In addition, MacNeil's air valve device appears to require a relatively large air pressure (approximately 40 psi) to move the air valve between its opened and closed positions.

It is therefore an object of the present invention to provide a vehicle dryer that can significantly reduce air pressure within the blower housing of the vehicle dryer during times when air flow is not needed, while allowing the fan to continue running during such times.

It is a further object of the present invention to provide such a vehicle dryer adapted to significantly reduce power consumption during times when air flow is not needed, while avoiding the need to power the motor off and back on.

It is a yet further object of the present invention to provide a mechanism to selectively block air flow at the inlet of a vehicle dryer that may be used with multiple types of vehicle dryers.

It is another object to provide such a vehicle dryer that is simple to operate, easy and inexpensive to construct, relatively compact, and which requires relatively few moving parts.

It is still another object of the present invention to provide a vehicle dryer that can quickly and easily be switched between high air flow and virtually no air flow while leaving the fan running continuously, while being capable of being operated with relatively low pneumatic actuation pressure.

Yet another object of the present invention is to provide such a vehicle dryer which avoids any significant discontinuities and/or restrictions in the path of air entering the blower housing when blown air is desired at the outlet of the vehicle dryer.

These and other objects of the present invention will become more apparent to those skilled in the art as the description of the present invention proceeds.

SUMMARY OF THE INVENTION

Briefly described, and in accordance with a preferred embodiment of the present invention, an apparatus is provided for blowing a stream of air at predetermined times. In the preferred embodiment, the apparatus is a vehicle dryer for directing a stream of air at a vehicle proximate thereto. The blower has a motor for rotating a drive shaft, and a fan is coupled to the drive shaft for being rotated about a first axis of rotation. The fan has an outer periphery and causes air to be discharged from the outer periphery when the fan is rotated by the motor. A housing encircles the fan, the housing including an entrance opening, or central air inlet, for admitting air to the fan. The housing also includes an outlet nozzle, and air discharged from the fan's outer periphery is directed outwardly by the housing through the outlet nozzle. In accordance with the invention, a valve is mounted for rotation about a second axis of rotation for controlling the flow of air through the central air inlet of the housing; in the preferred embodiment, this valve is located within the central air inlet of the housing. The valve has an open position to allow passage of air through the central air inlet, and a closed position for substantially blocking passage of air through the central air inlet. An actuator is coupled to the valve for selectively rotating the valve to its open position when air flow is desired, and to its closed position when air flow is not required. For example, in the case of a vehicle dryer, the actuator rotates the valve to its opened position when a vehicle is proximate to the vehicle dryer, and rotates the valve to its closed position when a vehicle is not proximate to the vehicle dryer.

In the preferred embodiment, the actuator is pneumatically controlled. The actuator may be supported by the fan housing, which can be advantageous if the housing is rocked to produce an oscillating air stream. As mentioned, the motor drive shaft rotates about a first axis of rotation, and the valve rotates about a second axis of rotation. The valve may be mounted to a rotatable valve shaft which extends along the aforementioned second axis of rotation. The valve shaft is preferably supported by bearings, and such bearing may advantageously be supported on opposite sides of the housing. Preferably, this second axis of rotation extends substantially perpendicular to the first axis of rotation. In the preferred embodiment, the valve is a generally circular plate, and the valve shaft intersects the circular plate substantially along a diameter of the circular plate. The central air inlet of the housing preferably includes a throat that is also generally circular in cross section, and having an inner diameter commensurate with the diameter of the circular valve plate.

Preferably, the first axis of rotation of the motor drive shaft, and the second axis of rotation of the valve shaft, are substantially co-planar. In the preferred embodiment, the first axis of rotation of the motor drive shaft passes substantially through the center of the valve plate.

In the preferred embodiment, one end of the rotatable valve shaft is attached to one end of a crank arm for selectively rotating the valve shaft along with the valve plate mounted thereto. The actuator may take the form of a pneumatic cylinder having a piston rod that can be selectively extended from, or retracted into, the cylinder. The free end of the piston rod is coupled to the opposite end of the crank arm for rotating the valve shaft, and the valve plate, about the second axis of rotation. Ideally, pneumatic control ports are provided at the opposing ends of the cylinder, and the piston rod can be positively extended, or positively retracted, by directing pressurized fluid to one or the other of the two control ports. In the preferred embodiment, the cylinder and piston rod serve to rotate the crank arm, and hence, the valve shaft, substantially ninety degrees as the piston rod moves from its retracted position to its extended position, and vice versa.

As noted above, the aforementioned valve is preferably located within the central air inlet of the housing to maintain a compact structure; in the preferred embodiment the central air inlet of the housing itself serves as an inlet passageway. For example, the housing includes a front wall with an aperture formed therein to form the entrance opening of the housing. In this instance, the inlet passageway may take the form of an inlet cone which extends into the housing through the entrance opening formed in the front wall.

Alternatively, the apparatus may include a separate inlet passageway for guiding incoming air into the entrance opening of the housing, and the valve may be rotatably mounted within the separate inlet passageway. For example, the housing may include a front wall having an aperture formed therein, again serving as an entrance opening to the housing. However, in this alternate embodiment, the inlet passageway and the valve are disposed ahead of the front wall of the housing in communication with the entrance opening of the housing. In this case, the valve is again rotated between an open position, for allowing airflow through the inlet passageway into the fan, and a closed position, for substantially blocking airflow through the inlet passageway into the fan. In this alternate embodiment, the valve preferably includes a generally circular plate or disc mounted upon the rotatable valve shaft, the inlet passageway is generally circular in cross section, and the circular valve plate has an outer diameter commensurate with the generally circular cross section of the inlet passageway. As before, the rotatable valve shaft preferably extends along a second axis of rotation that lies substantially perpendicular to the first axis of rotation of the motor drive shaft.

The present invention also provides a method of efficiently operating a vehicle dryer. A fan is supported for rotation within a housing, and the fan is rotated by a motor. The fan housing has a central inlet to supply air to the fan, and a discharge outlet for discharging air from the fan. A valve is mounted for rotation within the central inlet of the housing. The method includes the steps of rotating the valve to an open position when a vehicle is proximate to the discharge outlet for allowing air to be supplied to the fan; and rotating the valve to a closed position when a vehicle is not proximate to the discharge outlet for substantially blocking the passage of air to the fan. The motor requires significantly less energy to rotate the fan when the valve is rotated to its closed position. The valve is preferably rotated substantially ninety degrees from the closed position to the open position. The valve is preferably rotated about an axis that is substantially perpendicular to the axis of rotation of the fan.

BRIEF DESCRIPTION OF THE DRAWINGS

The present invention may more readily be understood by reference to the accompanying drawings in which.

DETAILED DESCRIPTION OF THE PREFERRED EMBODIMENTS

Figure 1:
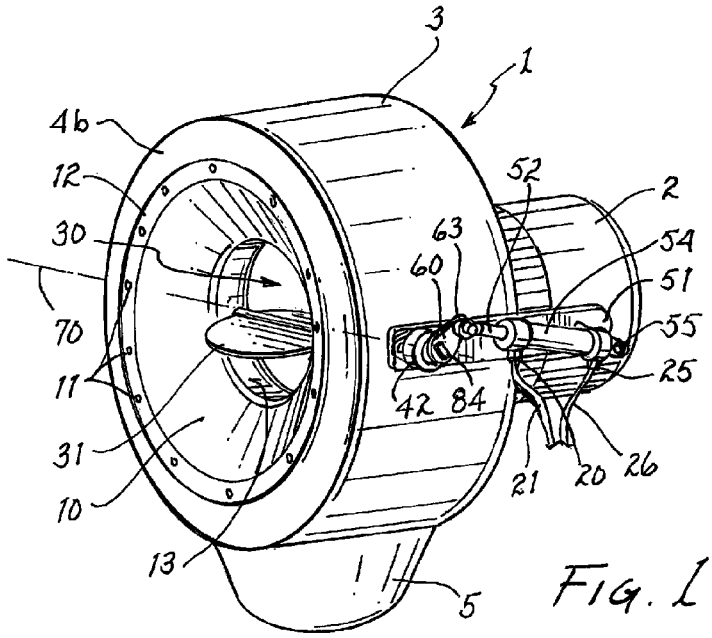
FIG. 1 is a perspective view of a blowing device constructed in accordance with a preferred embodiment of the present invention.
Figure 2:
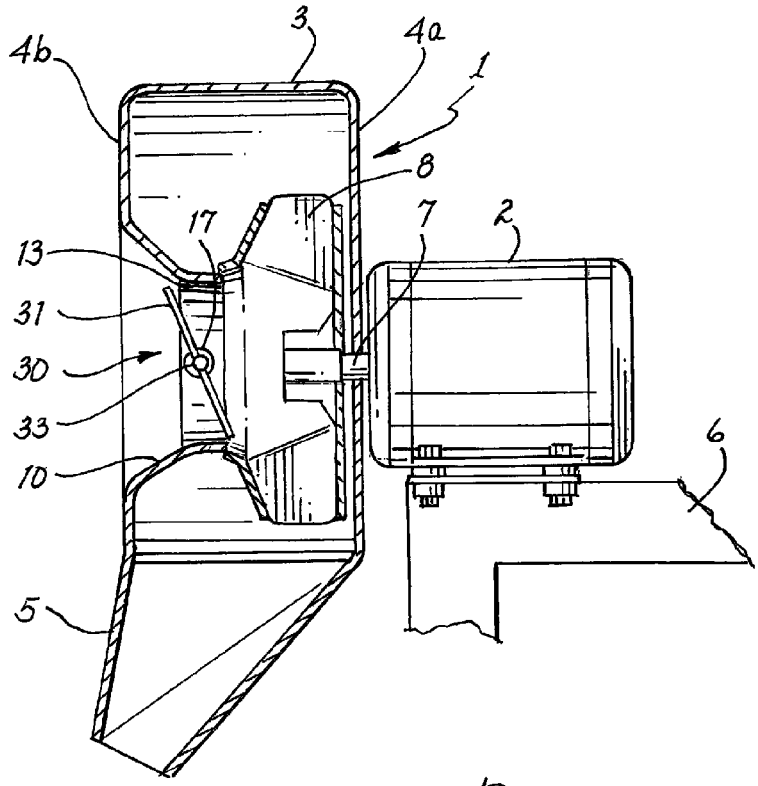
FIG. 2 is a cross-sectional view of the blowing device shown in FIG. 1.

Referring jointly to FIGS. 1 and 2, a vehicle dryer 1 is shown for blowing air at the surface of a vehicle (not shown) in accordance with a preferred embodiment of the present invention. Vehicle dryer 1 includes a blower housing 3 which includes an inlet cone 10. Blower housing 3 is preferably made from rotomolded polymer plastic. Impeller fan 8 is contained by blower housing 3 and is mounted to a drive shaft 7. Impeller fan 8 is adapted to receive air from inlet cone 10 in the central region of such fan, and to discharge air from its outer circumference; additional details concerning the structure and function of such impeller fans may be found in Applicant's earlier-issued U.S. Pat. No. 5,367,739. Drive shaft 7 extends through a hole in rear wall 4*a* of blower housing 3 for being rotated by motor 2. Motor 2, which is preferably an electric-powered motor, rotates drive shaft 7 and impeller fan 8 to discharge air out through outlet nozzle 5. Motor 2 is attached to a support bracket 6.

Blower housing 3 may be secured directly to motor 2 by bolts (not shown) connecting rear wall 4*a* to the front face of motor 2. Alternatively, blower housing 3 can be secured independently to support bracket 6, as by a support arm as shown in Applicant's U.S. Pat. No. 5,367,739. In those instances wherein the produced air stream should oscillate, the aforementioned support arm can be oscillated to rock blower housing 3 about fan 8 in the manner shown and described in Applicant's U.S. Pat. No. 5,367,739, the disclosure of which is hereby incorporated by reference.

Inlet cone 10 is preferably formed in the front wall of blower housing 3, and is preferably concentric with the axis of drive shaft 7. Inlet cone 10 is preferably made of metal, and is mounted within a central aperture formed in the front wall 4*b* of blower housing 3. Inlet cone 10 includes an outer circular mounting flange 12, and fasteners 11 are spaced circumferentially about the perimeter of mounting flange 12 for securing inlet cone 10 over front wall 4*b* of blower housing 3. If desired, a screen (not shown) may be secured over front wall 4*b*, and extending over inlet cone 10, to prevent foreign objects from entering inlet cone 10 and possibly interfering with impeller fan 8. Inlet cone 10 tapers inwardly toward an annular wall or throat 13.

A butterfly-type valve 30 is formed within inlet cone 10 by a rotatable disk 31. Disk 31 may be made of metal, preferably aluminum. In the preferred embodiment, disk 31 is circular in shape to match the circular shape of the throat of inlet cone 10. If inlet cone 10 is instead formed to have a throat of a non-circular shape (e.g., an oval shape or a rectangular shape), then "disc" 31 could be formed in a complimentary non-circular shape to match the shape of the throat of inlet cone 10.

Disk 31 is mounted upon a shaft 33 for rotation therewith. Shaft 33 extends generally perpendicular to drive shaft 7 of impeller fan 8. The length of shaft 33 slightly exceeds the diameter of blower housing 3. The diameter of disc 31 is slightly smaller than the inner diameter of throat 13 in inlet cone 10, thereby allowing clearance between disc 31 and throat 13 when disc 31 is rotated.

Figure 4:
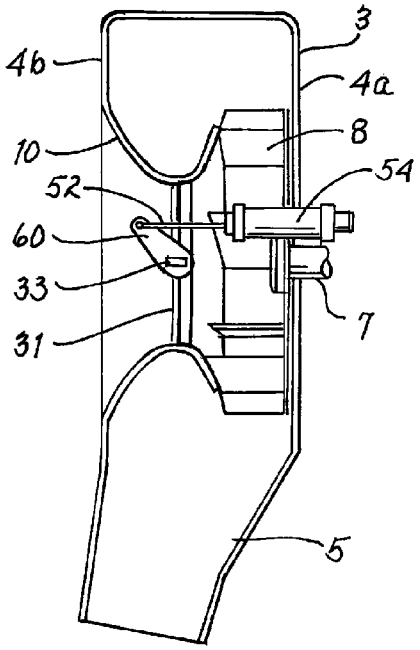
FIG. 4 is a first position partial side elevational cross-sectional view of the embodiment of FIG. 1.
Figure 5:
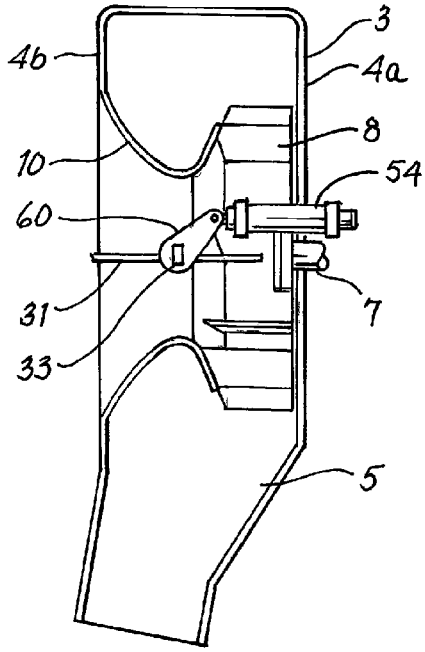
FIG. 5 is a second position partial side elevational cross-sectional view of the embodiment of FIG. 1.

Referring briefly to FIGS. 4 and 5, shaft 33 and disc 31 can be rotated between one of two positions. In FIG. 4, disc 31 is rotated to a vertical, or closed, position in which disc 31 essentially covers throat 13 within inlet cone 10. On the other hand, in FIG. 5, disc 31 is rotated to a horizontal, or opened, position in which air is free to pass into throat 13 of inlet cone 10.

Figure 6:
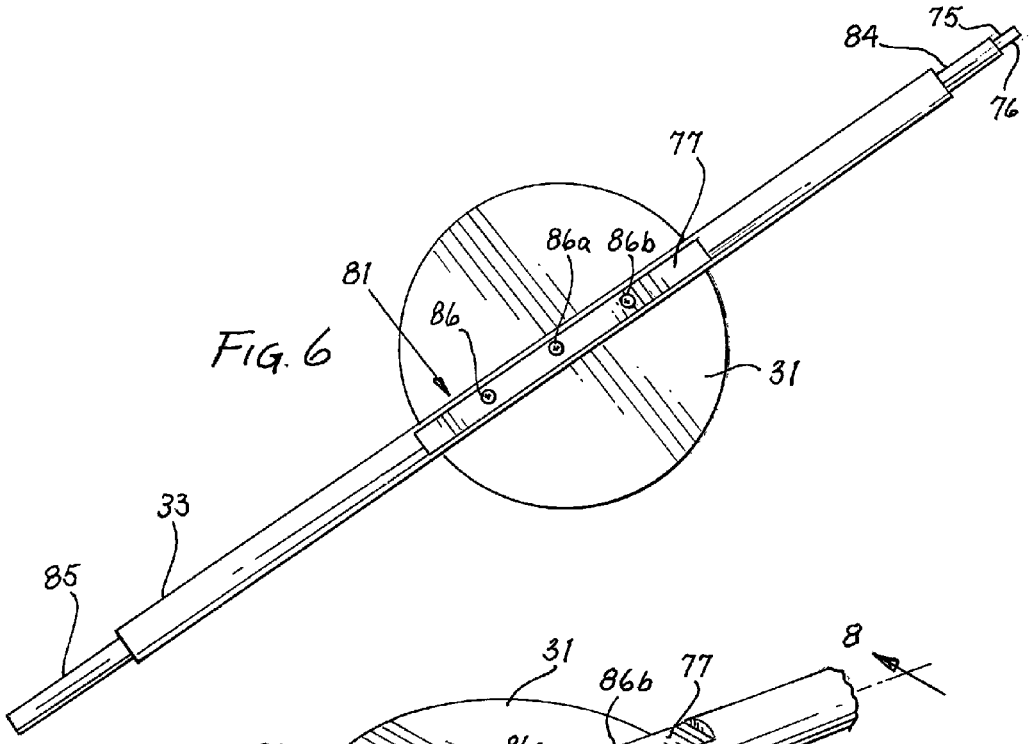
FIG. 6 is a top view of the butterfly valve axle and attached disc.
Figure 7:
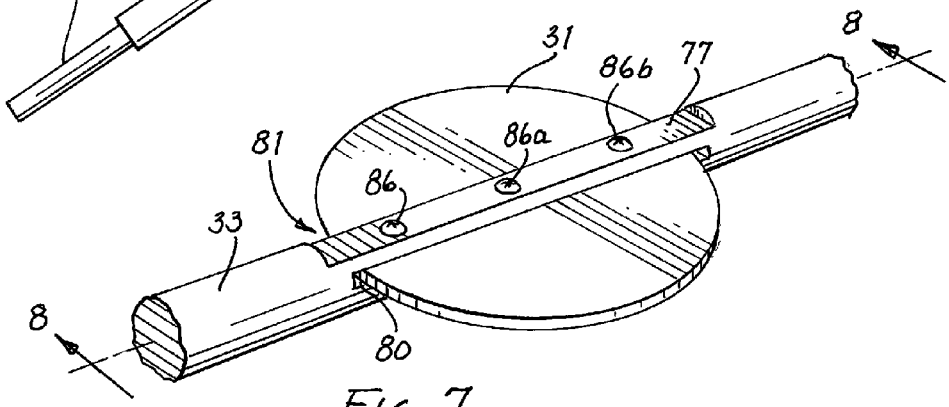
FIG. 7 is an enlarged perspective view of the disc shown in FIG. 6.
Figure 8:
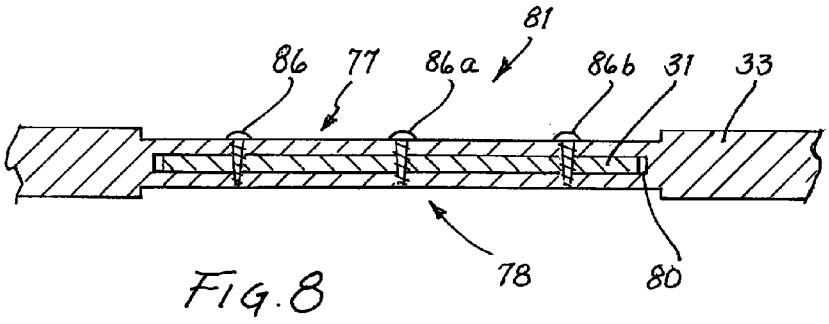
FIG. 8 is a sectional view of the valve axle and disc taken through section lines 8-8 in FIG. 7.

Turning briefly to FIGS. 6-8, the manner in which disc 31 is preferably supported by shaft 33 is shown in greater detail. Shaft is 33 preferably made of metal, and is generally cylindrical along its length. In the preferred embodiment, shaft 33 has a one-inch diameter. Center portion 81 of shaft 33 is preferably of a length equal to, or slightly greater than, the diameter of disk 31. Shaft 33 includes a central portion in which disc 31 is supported. Center portion 81 includes longitudinal slot 80. Slot 80 preferably includes spaced apertures for receiving fasteners 86, 86*a*, and 86*b* to secure disk 31 within slot 80 on shaft 33. Portions of shaft 33 disposed above and below slot 80 are machined away, or otherwise removed, to form two parallel flats 77 and 78, respectively, to minimize any restriction to airflow over shaft 33 when valve 30 is open.

Still referring to FIGS. 6-8, disk 31 is inserted into slot 80 of shaft 33 between flats 77 and 78, and is secured thereto via fasteners, e.g., screws 86, 86*a*, and 86*b*. Screws 86, 86*a*, and 86*b* are inserted through flat 77 of shaft 33, through disk 31 in slot 80, and then through flat 78 of shaft 33 to secure the disk into place and keep it from sliding out of the slot.

As shown in FIG. 6, shaft 33 preferably includes opposing reduced-diameter end portions 84 and 85, each of generally cylindrical shape. Such reduced diameter portions can be formed by machining shaft 33 at ends 84 and 85, and in the preferred embodiment, each of reduced diameter end portions 84 and 85 has a five-eighths inch diameter. Preferably, additional material is machined away, or otherwise removed from, the extreme end of reduced-diameter portion 84 to form two opposing flats 75 and 76, for reasons explained below.

Figure 3:
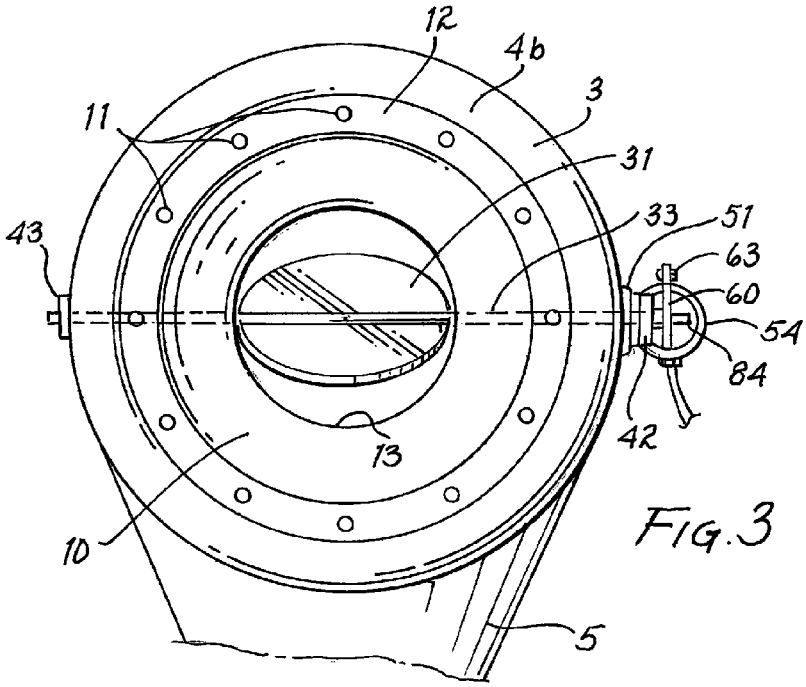
FIG. 3 is a an elevational view of a blowing device of the present invention.

End portion 84 extends through first bearing 42 (see FIGS. 1 and 3); in the preferred embodiment, first bearing 42 is secured to one side wall of blower housing 3. End portion 85 extends into a second bearing 43 (see FIG. 3); in the preferred embodiment, second bearing 43 is secured to an opposite side wall of blower housing 3. Bearings 42 and 43 are preferably flange bearings each having a ⅝ inch in internal diameter. In the preferred embodiment, bearings 42 and 43 are each secured by bolts to opposing side walls of blower housing 3. Preferably, a horizontally-extending support bar 51 is interposed between bearing assembly 42 and blower housing 3, and the bolts that secure bearing assembly 42 to blower housing 3 likewise secure support bar 51 to blower housing 3.

Bearings 42 and 43 allow shaft 33 to freely rotate about a first axis of rotation, designated by dashed line 70 in FIG. 1.

In the preferred embodiment, shaft 33 extends through blower housing 3 and inlet cone 10, as indicated in FIGS. 1-5. Two apertures, including aperture 17 shown in FIG. 2, are formed in the annular throat 13 of inlet cone 10 to permit shaft 33 to pass therethrough. End portion 84 of shaft 33 extends through and beyond bearing 42 for allowing flats 75 and 76 to engage a mating aperture formed in a lower end of crank arm 60, as shown in FIGS. 1 and 3-5.

As noted above, shaft 33 and disk 31 can be rotated between the closed position shown in FIG. 4, and the opened position shown in FIG. 5. A pneumatic cylinder 54 is provided to move shaft 33 and disk 31 between such closed and opened positions. Pneumatic cylinder 54 includes a first end 55 pivotally secured by a bolt to the rearward end of support bar 51. A piston rod 52 extends from the opposing end of cylinder 54. In a preferred embodiment, pneumatic cylinder 54 is an air cylinder of the type commercially available from Flodraulic Group, Inc. of Greenfield, Ind., under Model No. NCMC150-030-DUM0242. The aforementioned cylinder has a 1½ inch bore with a three-inch piston stroke.

The free end of piston 52 is coupled to the end of crank arm 60 opposite shaft 33 for rotating shaft 33 between its opened and closed positions. Preferably, a ball-and-socket joint 63 is used to secure the upper end of crank arm 60 to the free end of piston rod 52, both to form a pivotal connection therebetween, and to allow some "slop" in the alignment between pneumatic cylinder 54 and crank arm 60. Crank arm 60 preferably has an effective length of approximately 2¼ inches, as measured between end portion 84 of shaft 33 and ball-and-socket joint 63. Thus, crank arm 60 has a "lever arm" of approximately 2¼ inches. Cylinder 54, piston 52 and crank arm 60 collectively form an "actuator" for rotating valve shaft 33 and disk 31.

The length of crank arm 60, and the length of the stroke of piston rod 52, are selected to cause crank arm 60, and consequently valve shaft 33, to rotate essentially ninety degrees between opposite extremes of the cylinder piston travel. As indicated in FIGS. 4 and 5, this causes disk 31 to move between an essentially vertical orientation in the closed position of FIG. 4, to an essentially horizontal orientation in the opened position of FIG. 5. In the closed position of FIG. 4, valve 30 is closed, piston rod 52 is fully-extended, and crank arm 60 is rotated to its forwardmost position. On the other hand, in the opened position of FIG. 5, valve 30 is open, piston rod 52 is fully-retracted, and crank arm 60 is rotated to its rearwardmost position.

In the preferred embodiment, compressed air is used to control extension and retraction of piston rod 52. Pneumatic cylinder 54 includes a first pneumatic control port 20 disposed near the forwardmost (piston rod) end for receiving pressurized air to force piston rod 52 to retract within cylinder 54. Pneumatic cylinder 54 also includes a second pneumatic control port 25 to receive pressurized air to force piston rod 52 to fully-extend from cylinder 54. As will be appreciated by those skilled in the art, it is necessary to vent control port 25 to the atmosphere when control port 20 is pressurized. Likewise, it is necessary to vent control port 20 to the atmosphere when control port 25 is pressurized. Applicant has found that air pressurized to 20 psi is sufficient to operate cylinder 54 to rotate valve 30 between its opened and closed positions.

As shown in FIG. 1, first control port 20 is connected to one end of air hose 21, and second control port 25 is connected to one end of air hose 26. Air hoses 21 and 26 are each preferably ⅜ inch in diameter hoses. The opposite ends of air hoses 21 and 26 are coupled to a dual-port pneumatic valve (not shown).

Preferably, the aforementioned dual port pneumatic valve is of the type commercially available from the Flodraulic Group, Inc. of Greenfield, Ind. under Model No. NAS3201F-N02-11S. This dual-port pneumatic valve includes an inlet port for coupling to a source of pressurized air. It also includes two output ports and two vent ports. This dual-port pneumatic valve can switch between two states. In the first state, the first output port is coupled to the source of pressurized air, while the second output port is coupled to the second vent port. In the second state, the second output port is coupled to the source of pressurized air, while the first output port is coupled to the first vent port. This dual-port pneumatic valve includes adjustment knobs (not shown) on each of the output ports that may be rotated for making fine adjustments to the air flow rates through such output ports, and hence, through hoses 21 and 26. The ability to adjust the flow of pressurized air to control ports 20 and 25 allows for controlled acceleration and deceleration of piston-rod 52. This aids in avoiding any "slamming" of the valve as it changes to its opened or closed positions.

An air filter/regulator may be interposed between the source of pressurized air and the pressurized air port of the dual-port pneumatic valve to filter incoming air, and to regulate its pressure. Preferably, the air filter/regulator is of the type commercially available from Alternative Hose, Inc. of Phoenix, Ariz., under Model #B35-02AHCP.

The aforementioned dual-port pneumatic valve includes a control slide for moving between the two states. Preferably, an electrically controlled solenoid is used to move the aforementioned control slide between the two aforementioned states. The solenoid used in the preferred embodiment is commercially available from Controlled Motion Solution, Inc. of Buena Park, Calif. under Model No. B511ADH49C, which operates on 24 Volts D.C. When no current is applied to the solenoid, pressurized air is supplied through hose 26 to port 25 to fully-extend piston rod 52, and close valve 30; in this case, hose 21 vents port 20 of cylinder 54 to atmosphere. However, when current is applied to the solenoid, pressurized air is instead supplied through hose 21 to port 20 to fully-retract piston rod 52, and open valve 30; in this case, hose 26 vents port 25 to atmosphere.

In operation, a sensor (not shown) is provided near the vehicle dryer to sense whether a vehicle is in close proximity to the vehicle dryer. The sensor controls an electrical current the operates the aforementioned control solenoid. If the presence of a vehicle is not sensed, piston rod 52 remains extended, and valve 30 remains closed, severely restricting air flow through inlet 10, thereby starving fan 8 of air. Fan 8 will continue to turn inside blower housing 3, but the low pressure created in blower housing 3 allows the blades of the fan to turn more easily, thereby reducing energy consumed by the fan motor. Conversely, when the sensor senses the presence of a vehicle proximate the vehicle dryer, the control solenoid and dual-port pneumatic valve switch, retracting piston rod 52 into cylinder 54, opening valve 30, and allowing air to enter fan 8.

For example, for one particular fan that was tested, a vehicle dryer fan drew approximately 27 Amps of current with valve 30 in its opened position. On the other hand, upon closing valve 30, current drawn by the fan dropped to approximately 11 Amps, a reduction of approximately 41%. Thus, by preventing air from passing into inlet cone 10, fan 8 can be left on, and yet energy requirements are substantially lowered during periods when output air flow is not required to dry a vehicle.

Another aspect of the present invention relates to a method of more efficiently operating a vehicle dryer, including mounting valve 30 for rotation within central inlet 10 of blower housing 3. Fan 8 is supported for rotation within blower housing 3 and is rotated by motor 2 for blowing air through discharge outlet 5. The method includes the steps of rotating valve 30 to an open position when a vehicle is proximate to discharge outlet 5 for allowing air to be supplied through inlet 10 to fan 8, and rotating valve 30 to a closed position when a vehicle is not proximate to discharge outlet 5 for substantially blocking the passage of air through inlet 10 to fan 8. Motor 2 requires less energy to rotate fan 8 when valve 30 is rotated to its closed position.

Fan 8 is rotated about a first axis of rotation corresponding to the axis of motor 2 and drive shaft 7. Valve 30 is mounted for rotation about a second axis of rotation (70) substantially perpendicular to the aforementioned first axis of rotation. The step of rotating valve 30 to its closed position includes the step of rotating valve 30 approximately ninety degrees from its opened position. Similarly, the step of rotating valve 30 to its opened position includes the step of rotating valve 30 approximately ninety degrees from its closed position.

Those skilled in the art will appreciate that the valve mechanism and method herein described are useful for both stationary vehicle dryers and movable/oscillating vehicle dryers. Since, in the preferred embodiment, valve 30 is essentially incorporated into inlet 10 of blower housing 3, and because crank arm 60 and pneumatic cylinder 54 are also supported by blower housing 3, the only components that extend from blower housing 3 are flexible air hoses 21 and 26. Accordingly, even if blower housing 3 is rocked back and forth to oscillate the discharged air stream, hoses 21 and 26 do not interfere with such oscillatory movement.

In addition, the valve assembly described herein may also be used in conjunction with dual-port blower housings of the type described in Applicant's U.S. Pat. No. 6,000,095, wherein the blower is capable of selectively blowing air in either a forward or rearward direction. Such dual port blower housings may use the same inlet cone 10 for guiding incoming air into the fan, and valve 30 may easily be incorporated into such blowers for restricting air flow through inlet cone 10 when no vehicle is present.

The present invention has been described in terms of preferred embodiments thereof to facilitate the understanding of the principles of construction and operation of the invention. Such reference herein to a specific embodiment and details thereof is not intended to limit the scope of the claims appended hereto. For example, while it is preferred that valve disk 31 is circular, other shapes may also be used.

In addition, while it is preferred that valve 30 be incorporated within the conical tapered inlet 10 of blower housing 3 to avoid the need to expand the size of the dryer, it is also possible to form a rotatable valve in an inlet chamber that is disposed forwardly, rather than within, blower housing 3. Such an alternate embodiment is well-suited to retrofitting existing vehicle dryers to employ the benefits of the present invention.

It will be apparent to those skilled in the art that various other modifications may be made in the embodiments chosen for illustration without departing from the spirit and scope of the invention.

What is claimed is:

1. A blower for blowing a stream of air at predetermined times, said blower comprising in combination:

a. a motor for rotating a drive shaft;

b. a fan coupled to said drive shaft for being rotated thereby about a first axis of rotation, said fan having an outer periphery and causing air to be discharged from the outer periphery thereof when said fan is rotated by said motor;

c. a housing encircling said fan, said housing including a central air inlet for admitting air to said fan, said housing including an outlet nozzle, said housing receiving air discharged from the outer periphery of said fan and blowing the discharged air through the outlet nozzle;

d. a valve rotatably mounted within the central air inlet of said housing about a second axis of rotation, said valve having an open position for allowing passage of air through the central air inlet, and having a closed position for substantially blocking passage of air through the central air inlet; and e. an actuator coupled to the valve for selectively rotating the valve to its open position when a stream of air is desired, and to its closed position when a stream of air is not desired, said actuator selectively rotating the valve to its closed position even while said fan continues to be rotated by said motor.

2. The blower of claim 1 wherein said actuator is pneumatically controlled.

3. The blower of claim 1 wherein said actuator is supported by said housing.

4. The blower of claim 1 wherein said second axis of rotation is substantially perpendicular to said first axis of rotation.

5. The blower of claim 1 wherein the central air inlet of said housing is generally circular in cross section, and wherein said valve includes a circular plate coupled to a rotatable valve shaft, the circular plate having an outer diameter commensurate with the generally circular cross section of the central air inlet, and the rotatable valve shaft extending along said second axis of rotation.

6. The blower of claim 5 wherein the rotatable valve shaft is coupled to said circular plate substantially along a diameter of said circular plate.

7. The blower of claim 5 wherein said rotatable valve shaft is supported on bearings, said bearings being supported by said housing.

8. The blower of claim 5 wherein:

a. said rotatable valve shaft is coupled to a crank arm; and b. said actuator includes a pneumatic cylinder having a piston rod that may be extended therefrom, said piston rod being coupled to said crank arm for selectively rotating both said rotatable valve shaft and said valve about said second axis of rotation.

9. The blower of claim 8 wherein said pneumatic cylinder includes first and second opposing ends, said pneumatic cylinder including a first control port associated with the first end of said pneumatic cylinder, and wherein the application of pressurized fluid to said first control port urges said piston rod in a first direction.

10. The blower of claim 9 wherein said pneumatic cylinder includes a second control port associated with the second end of said pneumatic cylinder, and wherein the application of pressurized fluid to said second control port urges said piston rod in a second direction opposite to said first direction.

11. A vehicle dryer for directing a stream of air at a vehicle proximate thereto, said vehicle dryer comprising in combination:

a. a motor;

b. a fan coupled to the motor for being rotated thereby about a first axis of rotation, the fan being adapted to discharge air therefrom;

c. a housing surrounding the fan, the housing having an entrance opening adapted to admit air to the fan, the housing receiving air discharged from the fan and including an outlet nozzle for expelling air discharged by the fan;

d. an inlet passageway for guiding incoming air into the entrance opening of the housing;

e. a valve rotatably mounted within the inlet passageway, the valve having an open position for allowing air to pass through the inlet passageway into the fan, and the valve having a closed position for substantially blocking air from passing through the inlet passageway; and e. an actuator coupled to the valve for rotating the valve to its open position when a vehicle is proximate to the vehicle dryer, and rotating the valve to its closed position when a vehicle is not proximate to the vehicle dryer, said actuator selectively rotating the valve to its closed position even while said fan continues to be rotated by said motor.

12. The vehicle dryer of claim 11 wherein said valve includes a generally circular disc mounted upon a rotatable shaft.

13. The vehicle dryer of claim 11 wherein the inlet passageway is generally circular in cross section, and wherein said valve includes a circular plate coupled to a rotatable valve shaft, the circular plate having an outer diameter commensurate with the generally circular cross section of the inlet passageway.

14. The vehicle dryer of claim 13 wherein the rotatable valve shaft extending along a second axis of rotation, the second axis of rotation lying substantially perpendicular to said first axis of rotation.

15. The vehicle dryer of claim 14 wherein the first axis of rotation and the second axis of rotation are substantially coplanar.

16. The vehicle dryer of claim 15 wherein the first axis of rotation passes substantially through the center of the circular plate.

17. The vehicle dryer of claim 13 wherein:

a. the housing includes a front wall;

b. the entrance opening of the housing includes an aperture in the front wall of the housing; and c. the inlet passageway is an inlet cone extending into the housing through the entrance opening thereof.

18. The vehicle dryer of claim 13 wherein:

a. the housing includes a front wall;

b. the entrance opening of the housing includes an aperture in the front wall of the housing; and c. the inlet passageway and the valve are disposed ahead of the front wall of the housing communicating with the entrance opening of the housing.

19. A method of efficiently operating a vehicle dryer, said method comprising the steps of:

a. supporting a fan for rotation within a housing, the housing including a central inlet for supplying air to the fan and a discharge outlet for discharging air from the fan;

b. rotating the fan with a motor;

c. mounting a valve for rotation within the central inlet of the housing;

d. rotating the valve to an open position when a vehicle is proximate to the discharge outlet for allowing air to be supplied to the fan; and e. selectively rotating the valve to a closed position when a vehicle is not proximate to the discharge outlet for substantially blocking the passage of air to the fan even while said fan continues to be rotated by said motor;

whereby the motor requires less energy to rotate the fan when the valve is rotated to its closed position.

20. The method of claim 19 wherein the step of rotating the fan includes rotating the fan about a first axis of rotation, the step of mounting the valve includes the step of mounting the valve for rotation about a second axis of rotation, and wherein the second axis of rotation is substantially perpendicular to the first axis of rotation.

21. The method of claim 19 wherein the step of rotating the valve to the closed position includes the step of rotating the valve approximately ninety degrees from its open position.

* * * * *